US012566050B2

(12) United States Patent
Burton et al.

(10) Patent No.: US 12,566,050 B2
(45) Date of Patent: Mar. 3, 2026

(54) PROTECTIVE VEHICLE SURROUND SHIELD

(71) Applicant: TC Burton Enterprises LLC, Greenfield, IN (US)

(72) Inventors: Todd A. Burton, Greenfield, IN (US); Glenn M. Shanahan, II, New Palestine, IN (US); Chad A. Ringer, Trafalgar, IN (US)

(73) Assignee: TC Burton Enterprises, LLC, Greenfield, IN (US)

( * ) Notice: Subject to any disclaimer, the term of this patent is extended or adjusted under 35 U.S.C. 154(b) by 0 days.

(21) Appl. No.: 19/010,422

(22) Filed: Jan. 6, 2025

(65) Prior Publication Data

US 2025/0231012 A1 Jul. 17, 2025

Related U.S. Application Data

(60) Provisional application No. 63/621,241, filed on Jan. 16, 2024.

(51) Int. Cl.
*F41H 7/04* (2006.01)
*F41H 5/08* (2006.01)

(52) U.S. Cl.
CPC ..... *F41H 7/044* (2013.01); *F41H 5/08* (2013.01)

(58) Field of Classification Search
CPC ..... F41H 5/06; F41H 5/263; F41H 5/16
See application file for complete search history.

(56) References Cited

U.S. PATENT DOCUMENTS

| | | | | |
|---|---|---|---|---|
| 8,430,014 | B2 | 4/2013 | Burton | |
| 11,313,651 | B2 * | 4/2022 | Hadtke | F41H 5/08 |
| 2009/0100999 | A1 * | 4/2009 | Marqueling | F41H 5/226 89/36.08 |
| 2010/0024633 | A1 * | 2/2010 | Piscitelli | F41H 7/044 89/937 |

* cited by examiner

*Primary Examiner* — J. Woodrow Eldred
(74) *Attorney, Agent, or Firm* — Woodard, Emhardt, Henry, Reeves & Wagner, LLP

(57) ABSTRACT

An attachable and detachable surround shield assembly is mountable onto a host vehicle to convert the host vehicle into a protective mobile structure. The surround shield protects the occupant or occupants of the host vehicle from wind or debris and is made of a ballistic material that resists bullets, projectiles, and the like. Optionally, a rear platform mounted to the vehicle provides for the protected advance of multiple people. The surround shield includes hinged door panels that may be opened to allow for lateral protection of responders whether the vehicle is stopped or in motion.

18 Claims, 9 Drawing Sheets

PROTECTIVE VEHICLE SURROUND SHIELD

FIELD OF THE DISCLOSURE

The present invention relates generally to a surround shield assembly mountable onto a host vehicle such as an ATV/UTV creating an agile mobile shield.

BACKGROUND OF THE DISCLOSURE

Our world is becoming increasingly hostile. Threats are not only found in enemy territory or along our borders, but also within our schools, communities, and in both public and private spaces. Terrorist attacks and riots place innocent bystanders in harm's way.

Those who respond to the threats-law enforcement, security teams, and military forces, place their own lives at risk to protect the lives of others. There have been countless lives lost in the line of duty simply because the responder was not properly shielded or protected.

While armored tanks are utilized in the military, they are too large and cumbersome to be deployed into building structures and unable to navigate close, tight quarters. Armored tanks also struggle to traverse soft, muddy, or unstable ground. The substantial weight of a tank is also a considerable hinderance to its use in urban areas. While occupants of a tank are well protected, they are often restricted to a four-person crew. Fuel requirements are tremendous, traveling in ideal conditions at just 0.6 miles per gallon.

Often, the location of the crisis event requires responders to approach an assailant on foot. School shootings and mass shootings are on the rise in recent years. Responders must react quickly, with the knowledge that guns are involved and that the assailant is likely still armed and dangerous. Ballistic shields carried by responders are heavy and cumbersome and compromise the responder's ability to react or attack. The protection these handheld shields provide relies upon the strength and perseverance of the person carrying them. Responders need to be protected as they advance on an assailant in such a manner that they are not hindered in their capability to both attack and defend.

Vehicles such as all-terrain vehicles (ATVs), utility vehicles (UTVs), and compact 4×4 vehicles are widely used in law enforcement and military applications. These vehicles are generally lightweight, agile, and able to navigate confined spaces. In the case of compact 4×4s, responders may use vehicle doors as a makeshift shelter when they encounter gunfire or other forms of attack. While the vehicles are easily utilized to respond to crisis situations and the doors may be used as an impromptu shield when confronted by assailants, ATVS and UTVs and compact 4×4s often lack bullet-resistant protection, or even if the door contains ballistic material, that protection does not extend down to protect the legs and feet of the responder.

There is a need for an agile, mobile shield that can be used to quickly respond in the event of a school or mass shooting, hostage situation, riot, or other imminent threat to public safety. The mobile shield would quickly transform a practical-use host vehicle into a highly maneuverable transport that protects responders whether occupying the vehicle or approaching the assailant alongside the vehicle.

SUMMARY

An attachable and detachable protective surround shield assembly is mountable onto a host vehicle to convert the host vehicle into a protective mobile structure. The surround shield assembly protects the user or users of the host vehicle from wind or debris and, includes a ballistic material that resists bullets, projectiles, and the like. Optionally, a rear platform mounted to the vehicle provides for the protected advance of multiple people. The surround shield assembly includes hinged door panels that may be extended to allow for lateral protection of responders whether the vehicle is stopped or in motion.

An exemplary embodiment includes a protective surround shield assembly mountable onto a host vehicle to convert the host vehicle into a protective mobile structure. The surround shield assembly includes a frame mountable onto the host vehicle. The frame includes a front panel of a ballistic material facing toward the forward direction of the host vehicle. The front panel contains one or more sub-panels formed of a transparent material. The frame includes a pair of lateral side panels of a ballistic material, the lateral side panels extend rearward from the front panel and parallel to the sides of the host vehicle. Each lateral side panel defines an opening allowing users access to a seat area and a control portion of the host vehicle. The protective surround shield assembly further includes a pair of door panels of a ballistic material, each hingedly mounted to a respective lateral side panel. The door panels are operable between a closed configuration against the respective lateral side panel and covering the lateral side panel opening, and an open configuration allowing users access to a seat area and control portion of the host vehicle.

In an alternate embodiment, a protective surround shield assembly is mountable onto a host vehicle to convert the host vehicle into a protective mobile structure. The protective surround shield assembly includes a frame mountable onto the host vehicle wherein the frame is attachable and detachable from the host vehicle utilizing a quick mounting system. The frame includes a front panel of a ballistic material facing the forward direction of the host vehicle. The front panel contains one or more sub-panels formed of a transparent material. The frame includes a pair of lateral side panels of a ballistic material extending from the front panel rearward and parallel to the sides of the host vehicle. Each lateral side panel defines an opening allowing users access to a seat area and a control portion of the host vehicle. The frame includes a rear panel of a ballistic material facing the rearward direction of the host vehicle, and a pair of door panels of a ballistic material, each hingedly mounted to a respective lateral side panel.

In a further embodiment, a protective surround shield assembly is mountable onto a host vehicle to convert the host vehicle into a protective mobile structure. A frame is mountable onto the host vehicle wherein the host vehicle is an all-terrain vehicle (ATV), a utility vehicle (UTV) or a compact 4×4 vehicle. The frame includes a front panel of a ballistic material generally facing the forward direction of the host vehicle. The front panel contains one or more sub-panels formed of a transparent material. The frame includes a rear panel of a ballistic material facing the rearward direction of the host vehicle. The frame further includes a pair of lateral side panels of a ballistic material extending from front panel to the rear panel. Each lateral side panel defines an opening allowing users access to a seat area and a control portion of the host vehicle. A pair of door panels of a ballistic material are each hingedly mounted to a respective lateral side panel. The door panels are operable between a closed configuration covering the openings in the respective lateral side panels and an open configuration.

Other objects and attendant advantages will be readily appreciated as the same become better understood by references to the following detailed description when considered in connection with the accompanying drawings.

DETAILED DESCRIPTION

Figure 1:
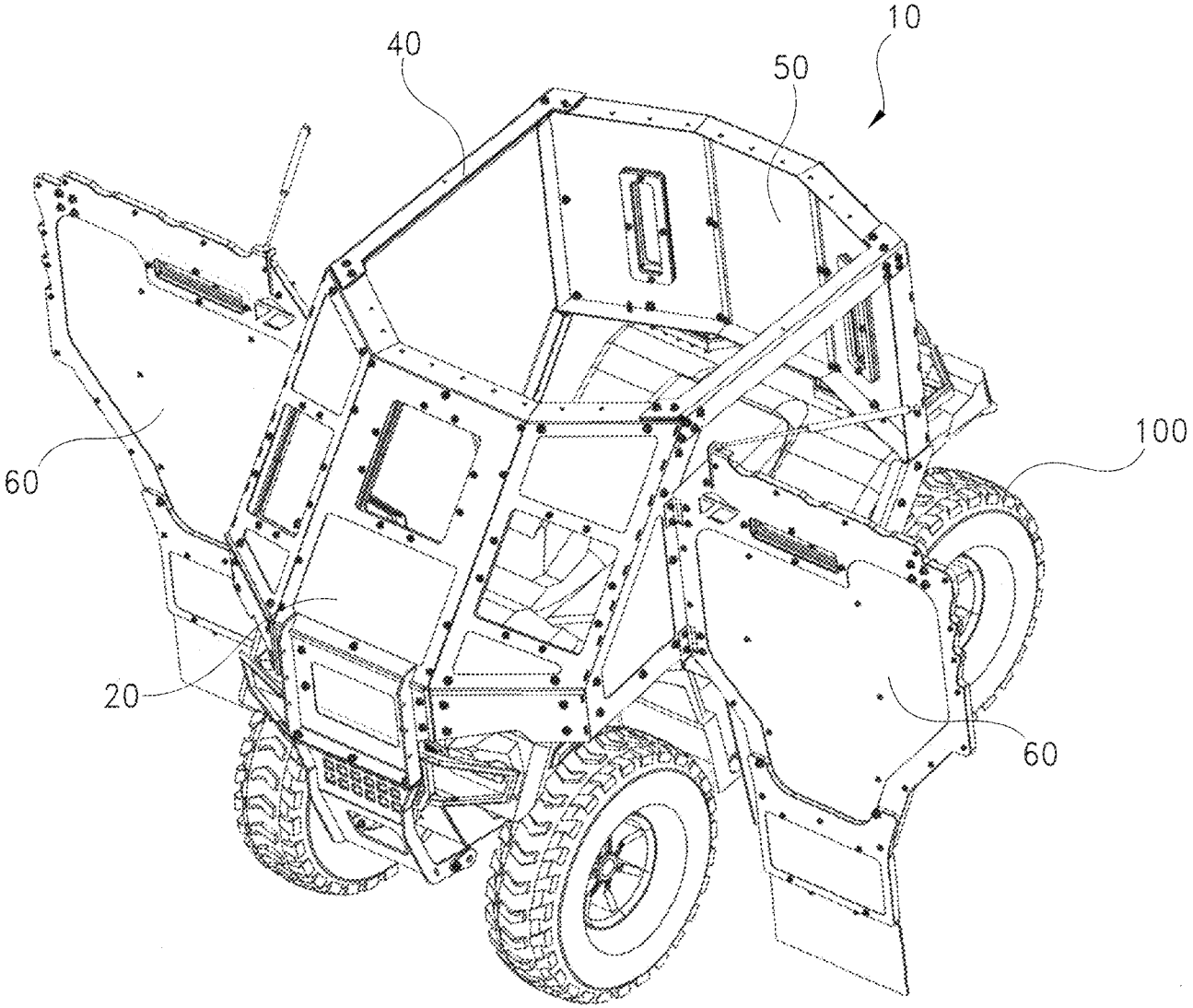
FIG. 1 is a perspective view of a surround shield assembly as disclosed mounted on a representative host vehicle.

For the purpose of promoting an understanding of the principles of the disclosure, reference will now be made to the examples illustrated in the drawings and specific language will be used to describe the same. It will nevertheless be understood that no limitation of the scope of the disclosure is thereby intended. Any alterations and further modifications in the described examples, and any further applications of the principles of the disclosure as described herein are contemplated as would normally occur to one skilled in the art to which the disclosure relates. Certain examples of the disclosure are shown in detail; although it will be apparent to those skilled in the relevant art that some features which are not relevant to the present disclosure may not be shown for the sake of clarity.

Directional references herein are for ease of explanation and are not intended to be limiting.

Embodiments of the present disclosure include a protective surround shield assembly of a ballistic material attachable to a host vehicle, preferably an ATV or UTV yet alternately a compact 4×4, for use in potentially dangerous situations. The shield assembly is compact, mobile and easily mountable and removable, to allow the vehicle and shield assembly to be rapidly deployed into or around buildings, confined spaces or other potentially dangerous situations, providing consistent protection as one or more responders approaches an assailant or imminent threat. In a closed configuration, the occupant or occupants of the host vehicle are preferably protected by a 360 degree surround shield assembly. As desired, hinged door panels (allowing ingress and egress) of the assembly may be rotated or deployed to an extended or open configuration facing forward, allowing for the protection of users in and adjacent to the vehicle from bullets or projectiles while the vehicle is either stopped or advancing.

An optional platform attachment may be located behind the vehicle and the shield. For instance, the platform may be mounted to a trailer hitch of the host vehicle. The platform assembly allows for safe transportation of additional personnel or equipment. In the illustrated embodiment, additional personnel may stand on the platform and grasp onto the surround shield by means of straps, handles, bars or another method of securing themselves while the host vehicle is in motion.

In certain embodiments, the door panels include vertical extension panels, which can be deployed below the panels in the open configuration. The extension panels assist in protecting the legs and feet of responders standing beside the host vehicle and behind the door panels.

As shown in FIG. 1, the surround shield assembly 10 is mountable to a host vehicle 100. A representative host vehicle 100 based on a POLARIS® Sportsman 850 Ultimate Trail is illustrated in FIG. 1. The host vehicle is preferably a utility vehicle such as an all-terrain vehicle (ATV) or a utility vehicle (UTV) or alternately a compact 4×4 vehicle. In other embodiments, the host vehicle may an off-road vehicle, an on-road vehicle, a dune buggy, skid-steer loader, bulldozer, small tractor or the like. The host vehicle typically includes at least a vehicle frame, a seat area or seats for occupants, controls, and a power drive system which drives ground support elements such as wheels or tracks.

As illustrated in detail in FIGS. 1-6, the surround shield assembly 10 is composed of a series of panels forming a frame. The panels are typically made from a rugged material, preferably the panels or sub-panels are made of a clear or opaque ballistic material capable of resisting bullets and projectiles. Preferably the ballistic material is capable of NIJ III/CEN B-6 ballistic protection. Examples of ballistic materials may include, but are not limited to, appropriately made hardened steel, ballistic glass, ceramic, fiberglass, wood, kevlar, polyethylene, and polycarbonate. The panels or sub-panels may be made of clear or opaque materials.

The panels may be formed using sub-panels. The panels may be connected with suitable fasteners such as bolts, screws, rivets or the like. In some embodiments, the panels may be easily disassembled or disconnected from each other for transport, storage or replacement. Alternately, one or more panels or portions of panels may be integrally formed or permanently connected via welding, casting, molding or the like. The frame may be pre-assembled, typically having four sides, and is preferably attachable and detachable from the host vehicle 100 utilizing a quick mounting system. In a less preferred variant, the frame could be used without a rear side.

Surround shield assembly 10 includes a front panel 20 which may be an assembly of sub-panels. As illustrated, front panel 20 includes a central front panel 22 facing toward the forward direction of the host vehicle. Front panel 22 is substantially perpendicular or generally transverse to the forward movement axis of the host vehicle. Portions of central front panel 22 may be upright or angled rearwardly with respect to a vertical axis. As illustrated, front panel 20 further includes a pair of side front panels, including right side front panel 24 and left side front panel 26. The side front panels are angled and sized to extend from the lateral edges of central front panel 22 to forward edges of lateral side panels 40. Front panel 20 may include one or more sub-panels, such as sub-panels 28, formed of a transparent material, such as ballistic glass, which serve as windows or viewing ports. In alternate embodiments, all or portions of front panel 20 may be formed of a suitable transparent material forming a windshield, and front panel may be configured in different shapes, such as a curved windshield.

Front panel 20 may further include a nose panel 30 extending downward to mounting points 32 configured to be attachable to suitable mounting points on the front portion of the frame of the host vehicle. As representative examples, mounting points 32 may be secured using fasteners such as bolts or quick release mechanisms such as retaining pins or mated couplings. Nose panel 30 may protect the front end and/or grill and radiator of the host vehicle.

Surround shield assembly 10 includes a pair of lateral side panels 40 extending from front panel 20 to rear panel 50 and parallel to the sides of the host vehicle. The lower ends of lateral side panels 40 are configured to be attachable to suitable mounting points on side portions of the frame of the host vehicle, for instance using brackets 42 and fasteners such as bolts or quick release mechanisms such as retaining pins or mated couplings.

Each lateral side panel 40 defines an opening 46 allowing users access to the seat area and control portion of the host vehicle. Lateral side panels 40 form frames and mounting points for door panels 60 which all or partially cover each opening 46 when closed. A step 48 may be arranged adjacent a lower portion of each side lateral side panel 40 to assist users in entering or exiting the surround shield assembly to sit on or in the host vehicle.

Surround shield assembly 10 further includes a rear panel 50 which may be an assembly. As illustrated, rear panel 50 includes a central rear panel 52 facing toward the rearward direction of the host vehicle and are substantially perpendicular or transverse to the forward movement axis of the host vehicle. Rear panel 50 further includes a pair of side rear panels, including right side rear panel 56 and left side rear panel 58. The side rear panels may be angled and extend from the lateral edges of central rear panel 52 to rear edges of lateral side panels 40. Rear panel 50 may include one or more sub-panels, such as sub-panels 58, formed of a transparent material which serve as windows or viewing ports. In alternate embodiments, all or portions of rear panel 50 may be formed of a suitable transparent material forming a rear windshield, and the rear panel may be configured in different shapes.

A pair of door panels 60, alternately referred to as ingress and egress panels, may be mounted to respective lateral side panels 40. Door panels 60 are parallel to and hingedly mounted to lateral side panels 40 via a pair of hinges 66. Door panels 60 may include one or more sub-panels, such as sub-panels 68 formed of a transparent material which serve as windows or viewing ports. Alternately, door panels 60 may be made of a transparent material. Optionally, actuators 69 such as gas shocks extending between lateral side panels 40 and the door panels 60 may be used to hold door panels 60 in an open position, to dampen the speed at which door panels 60 may be opened or closed and/or to provide a limit to the position door panels 60 can be opened.

Figure 2:
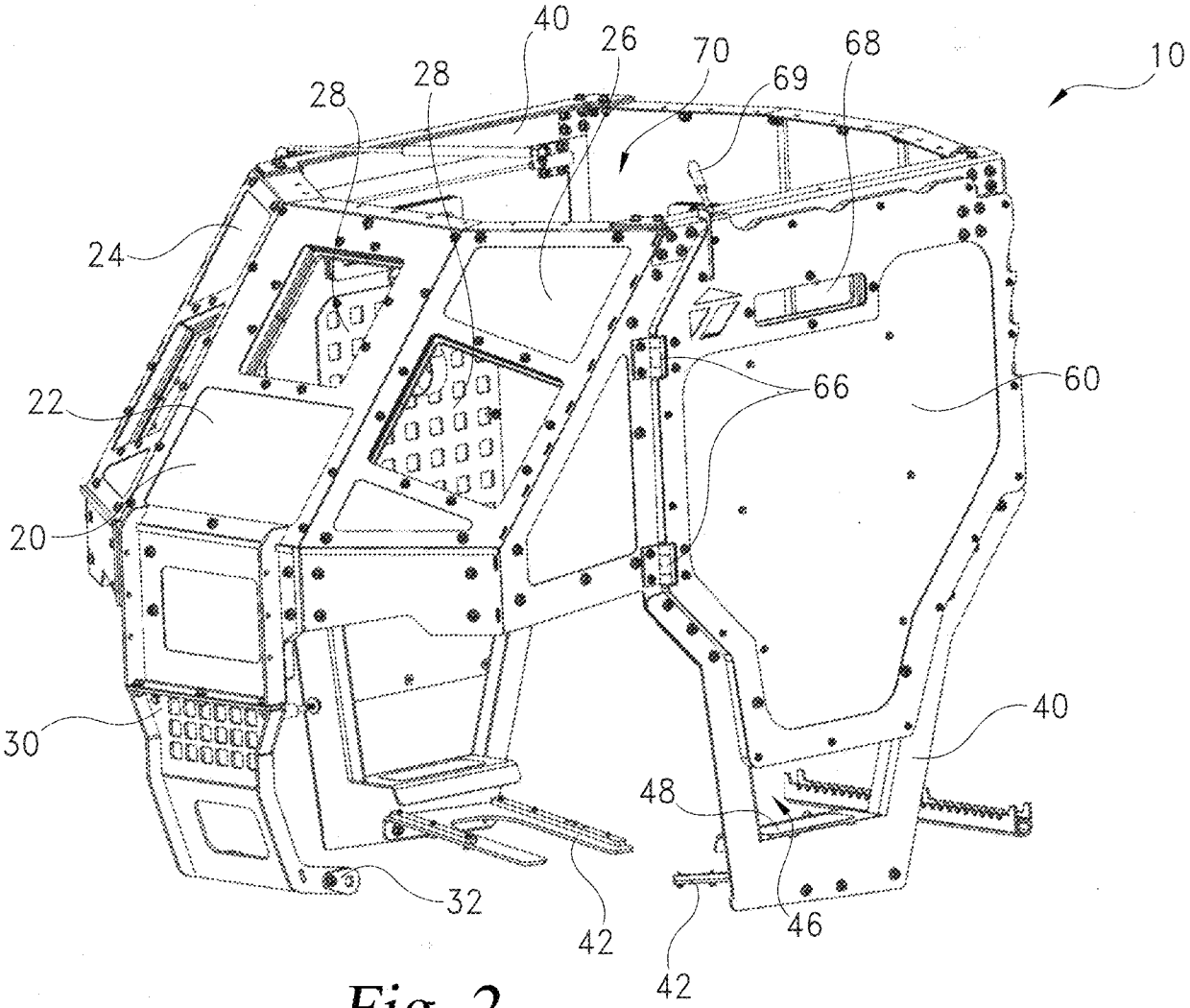
FIG. 2 is a perspective view of the surround shield of FIG. 1 in a closed configuration.

In a closed configuration as shown in FIG. 2, the door panels are retracted or closed and latched against the respective side lateral panels 40 to enclose and protect the occupant or occupants from wind, debris, bullets, or projectiles whether the host vehicle is stopped or in motion.

Figure 3:
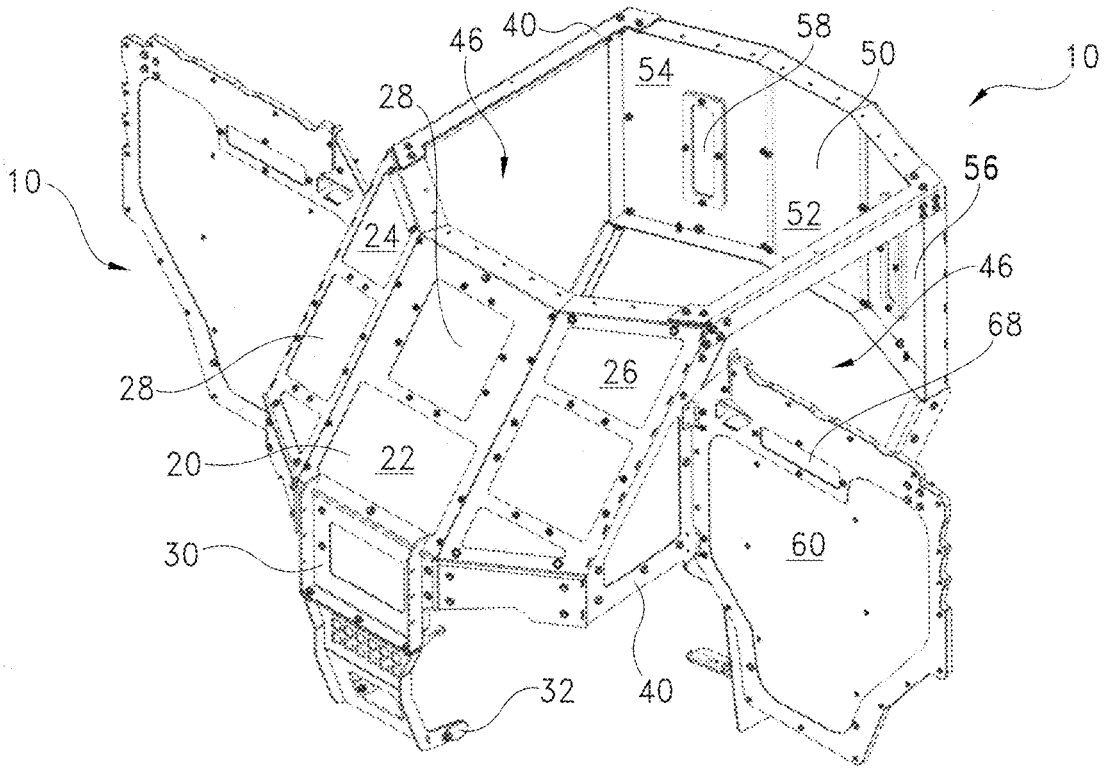
FIG. 3 is a perspective view of the surround shield of FIG. 1 in an open configuration.
Figure 4:
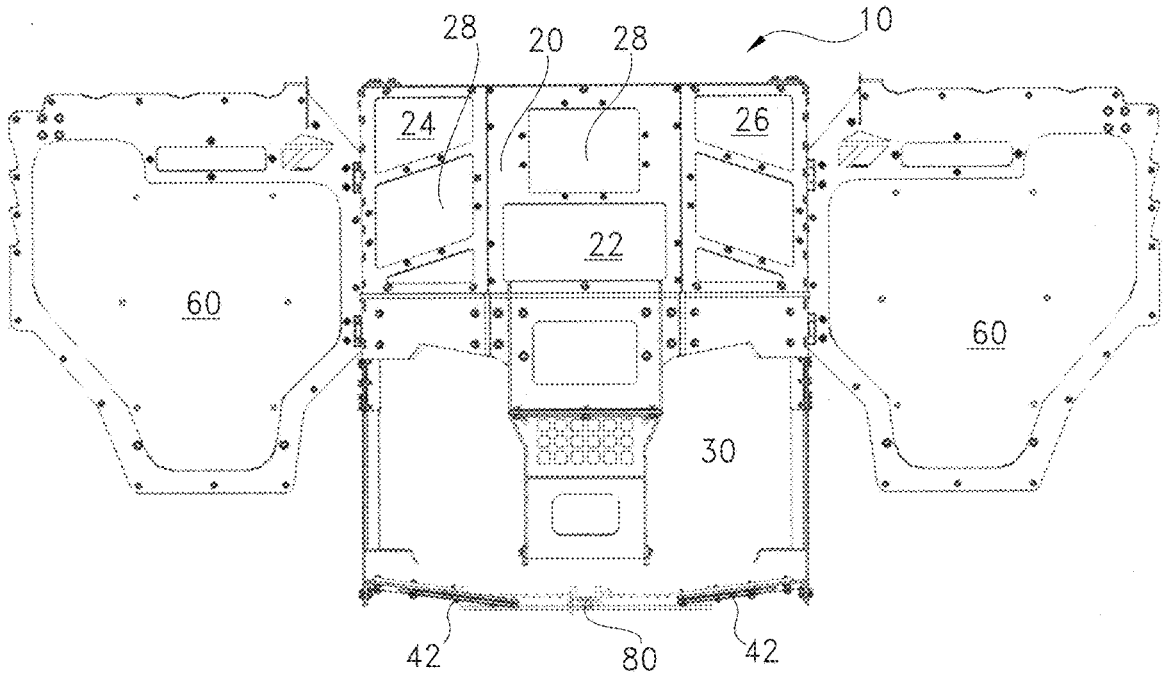
FIG. 4 is a front view of the surround shield of FIG. 1 in an open configuration.
Figure 6:
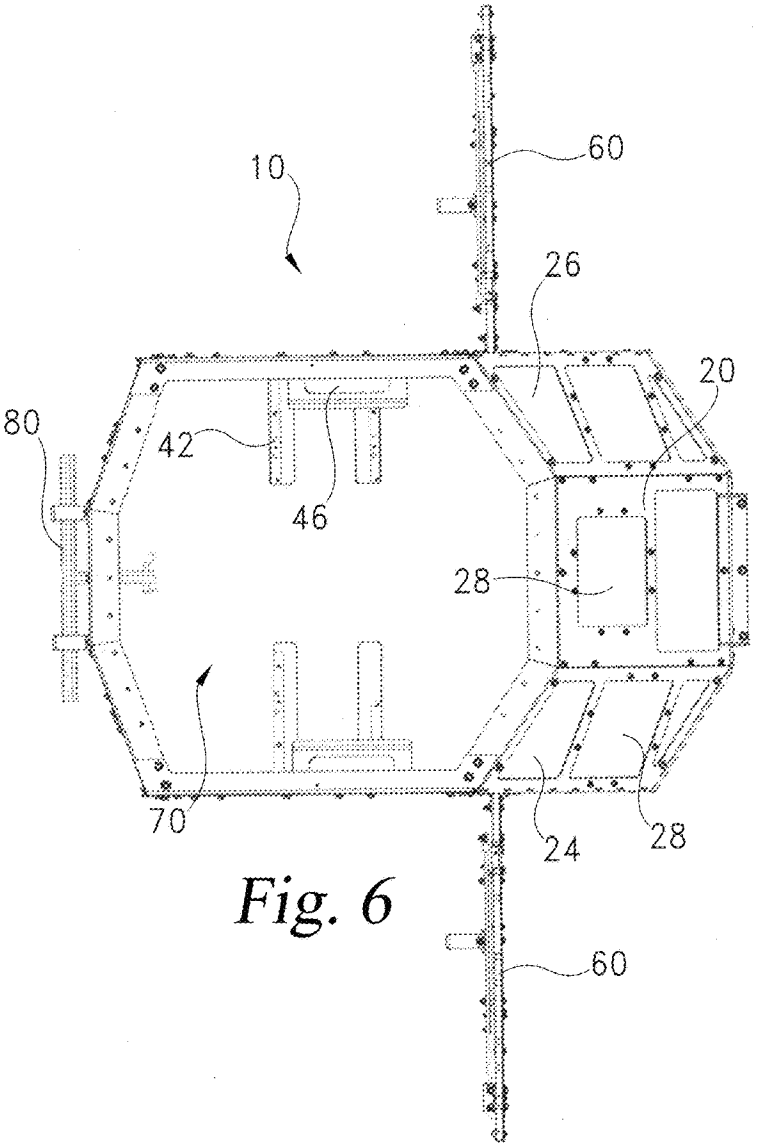
FIG. 6 is a top view of the surround shield of FIG. 1 in an open configuration.
Figure 5:
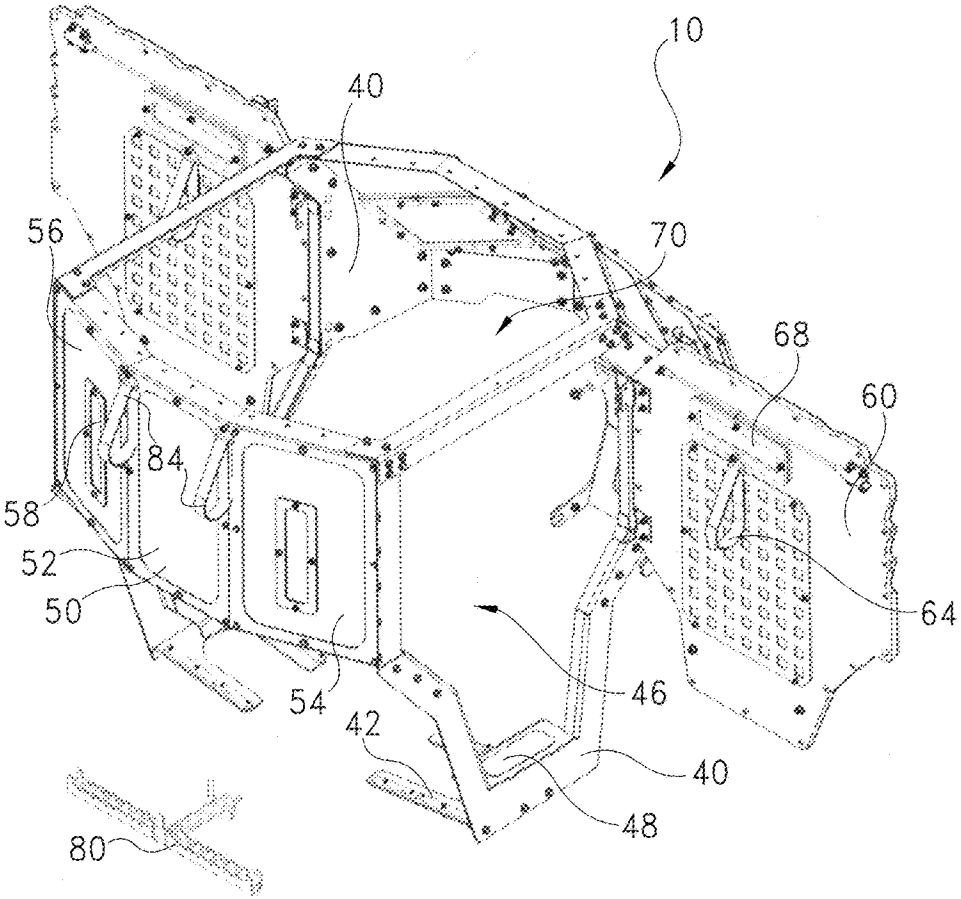
FIG. 5 is a perspective rear view of the surround shield of FIG. 1 in an open configuration.

In an open configuration, as shown in FIG. 3 the door panels 60 of the surround shield assembly 10 are unlatched and rotated outward or expanded to be substantially perpendicular to the respective side lateral panels 40. In the open configuration, the door panels 60 are forward facing and provide an extended forward facing protective face in cooperation with front panel 20. In the open configuration, the door panels 60 provide protection to users on the ground adjacent to the vehicle whether the vehicle is stopped or in motion. Whether retracted or expanded, the weight of the hinged door panels is supported by the surround shield which is mounted to and advanced by the host vehicle.

Figure 7:
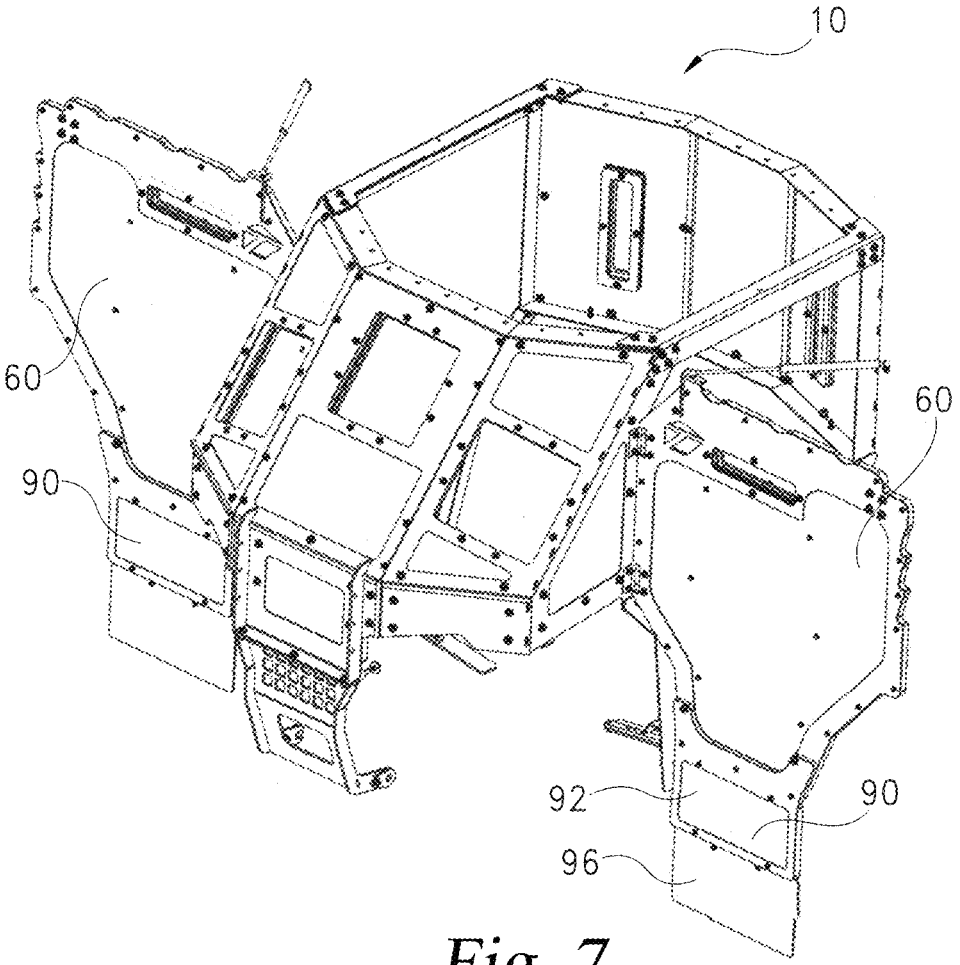
FIG. 7 is a perspective view of the surround shield of FIG. 1 in an open configuration and with extension panels.
Figure 8:
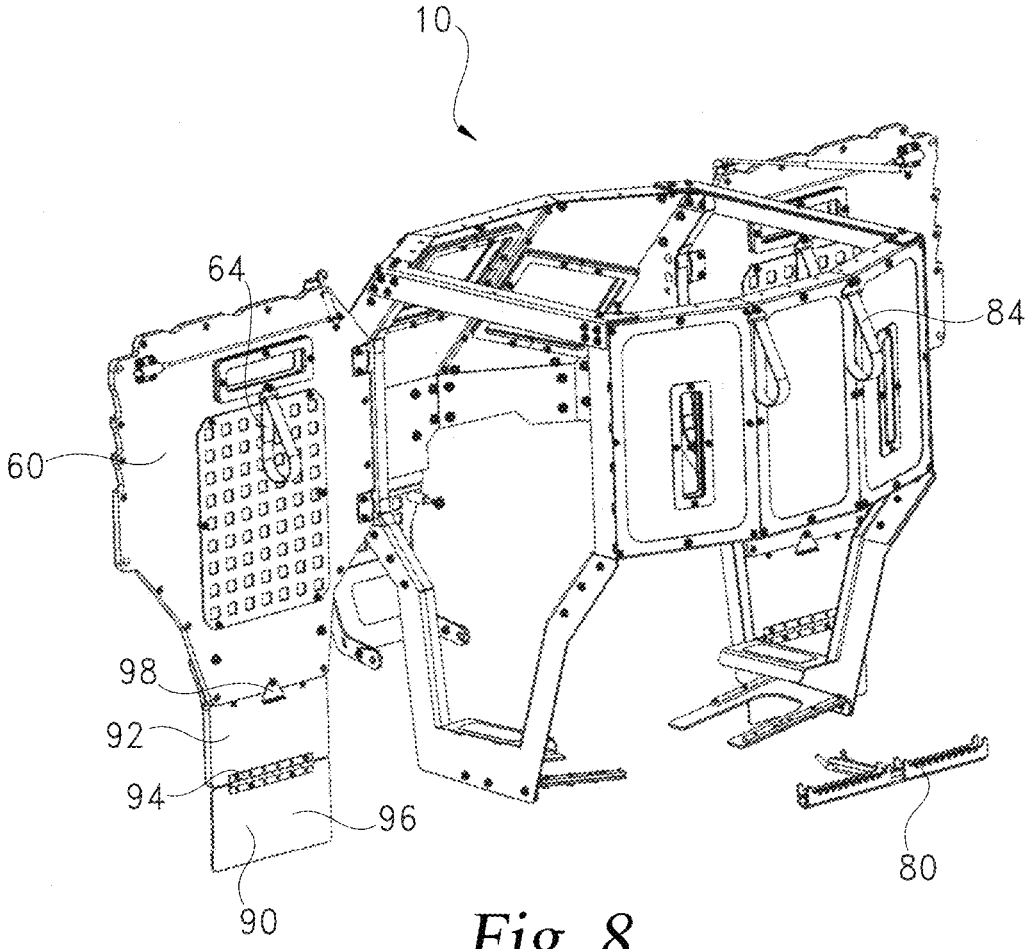
FIG. 8 is a rear view of the surround shield of FIG. 7.
Figure 9:
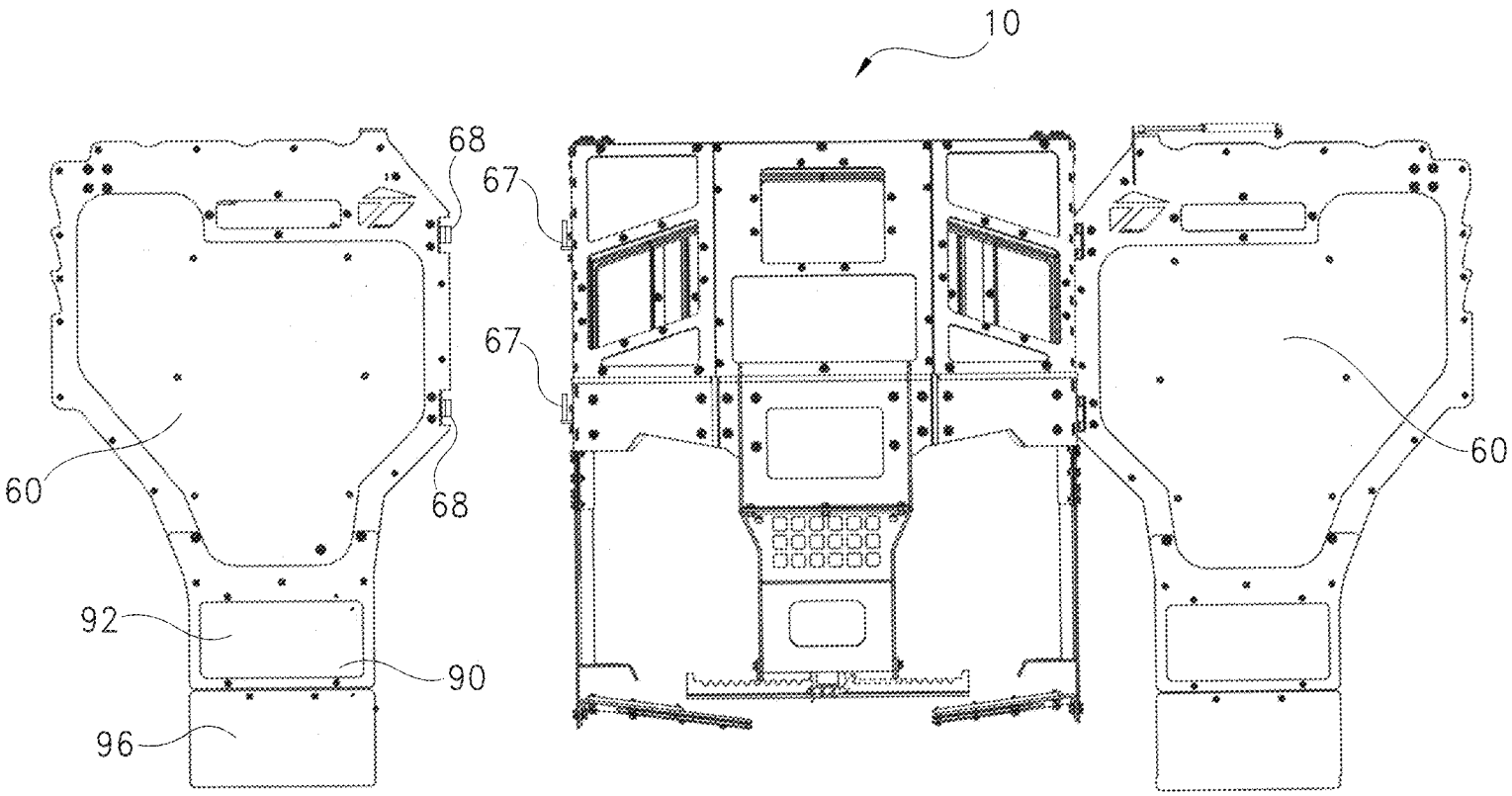
FIG. 9 is a front view of the surround shield of FIG. 1 with a door panel removed to use as a portable shield.

In yet another embodiment, as illustrated in FIGS. 7-9, the door panels 60 may optionally contain extension panels 90. An extension panel may extend downward and/or may be lowered to provide protection to the legs and feet of a responder standing behind a door panel. The extension panels 90 are formed of a protective preferably ballistic material. In the illustrated embodiment, extension panels 90 include an upper panel 92 fixed to a door panel 60 and a lower panel 96. Lower panel 96 is connected to upper panel 92 via hinge 94, allowing lower panel 96 to be folded upward for storage or deployed downward. In alternate embodiments one fixed panel can be used or two or more folding panels may be used with or without a fixed panel. In a still further embodiment, the extension panels may be mounted to slide vertically between a deployed position and a stored position.

Extension panel 96 may be selectively returned to a storage position. A retaining clip 98 may hold lower panel 96 in the stored position. Alternately a latch mechanism or a magnetic mechanism may secure lower panel 96 in the stored position.

In yet another embodiment, as illustrated in FIG. 9, the door panels 60 may be removable from hinges 66 by the users when desired and may be used as portable shields. For instance, portions of hinges 66 on the lateral side panels may include upward facing pins 67 while portions of hinges 66 on the door panels 60 define hinge cylinders 68 which fit over pins 67. In this embodiment, the door panels 60 may be removed from the frame by users by lifting the door panels 60 and hinge cylinders 68 vertically and off of the hinge pins 67. The interior side of door panels 60 may include straps or handles 64 (visible in FIGS. 6 & 8) allowing users to carry and maneuver the door panels as portable shields.

Figure 10:
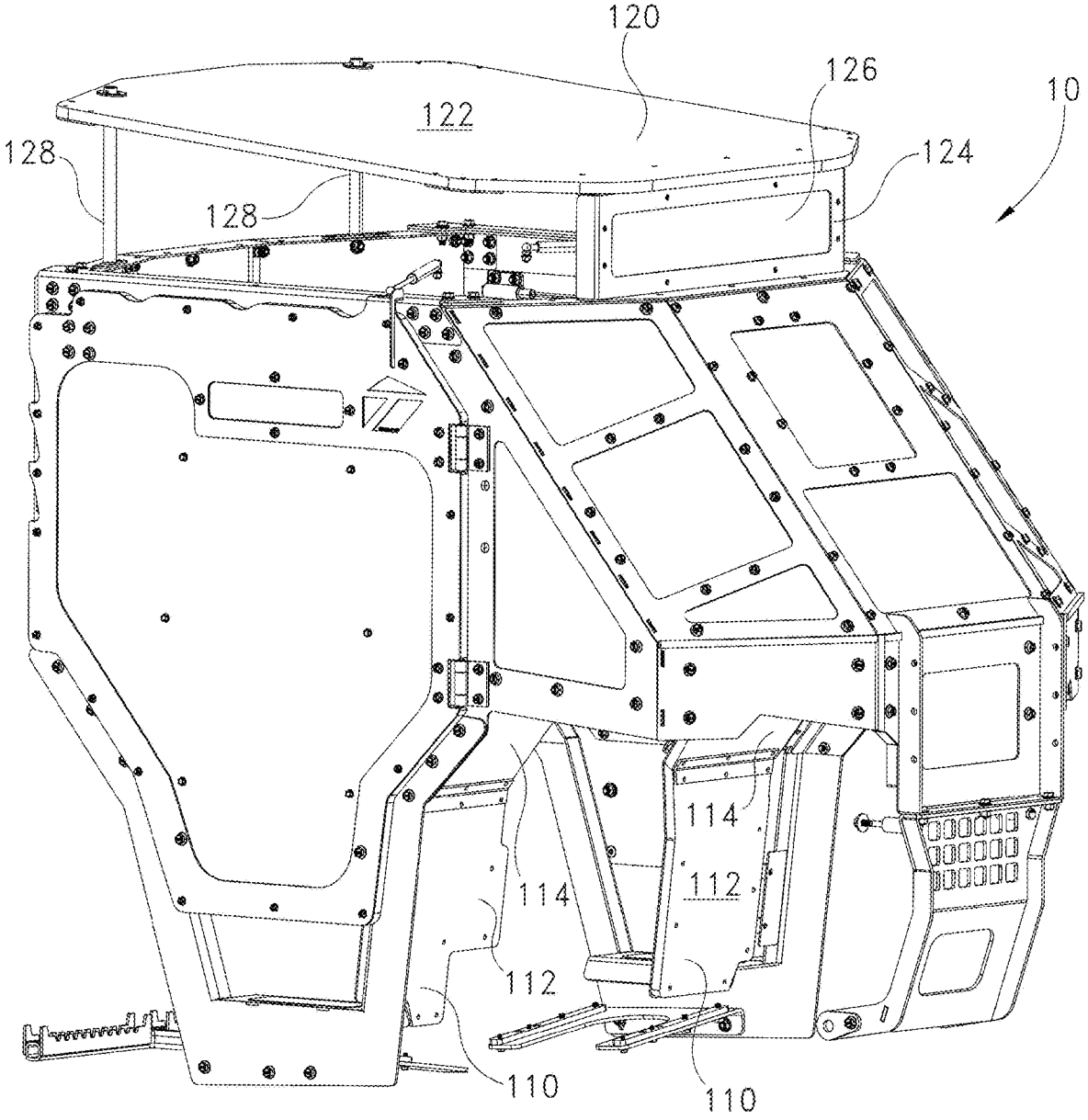
FIG. 10 is a perspective front view of an alternate embodiment of the surround shield of FIG. 1.
Figure 11:
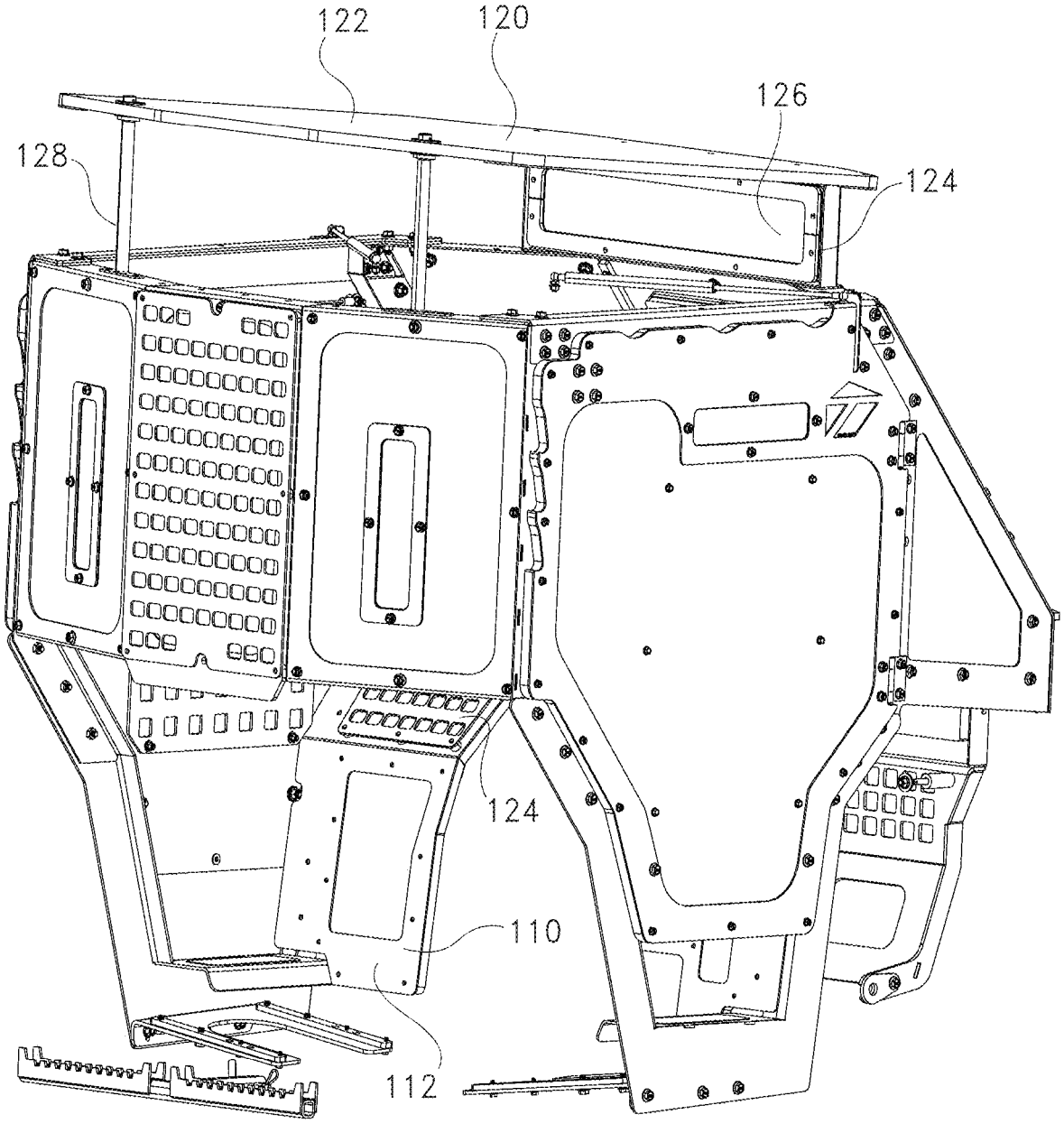
FIG. 11 is a perspective rear view of the embodiment of FIG. 10.

In the illustrated embodiment, surround shield assembly 10 has an open top 70. Optionally, a roof panel assembly 120 as illustrated in FIGS. 10 and 11 may be used to partially enclose or cover the surround shield assembly 10 and attached to the upper frame of the surround shield to provide protection from the elements or in dangerous situations. As illustrated roof panel assembly 120 include top roof panel 122. Top roof panel 122 may be adjacent or spaced and supported slightly above the upper frame of the surround shield. In some embodiments, a front edge of top panel 122 is supported by a forward roof panel 124 extending from the upper frame of the surround shield to top roof panel 122. Optionally, forward roof panel may include a transparent subpanel 126. As illustrated, top roof panel 122 is supported along a rear edge and adjacent the rearward corners by a pair of support posts 128. The size, shape and location of the components of the roof panel assembly may be arranged and configured as desired. The roof panel assembly may be opaque or transparent or may contain sub-panels to make portions transparent. In yet another embodiment, the roof panel assembly may include a dome. In still further embodiments, all or portions of the roof panel assembly may be openable or retractable.

In an optional accessory, surround shield assembly 10 may include a rearward extending platform 80 which can be secured to a trailer hitch on the host vehicle. Platform 80 is illustrated as a horizontal bar, and provides room for one or more responders to step on and ride on the platform while protected behind surround shield assembly 10 and the host vehicle. Rear panel 50 may include straps or handles 84 for responders to hold onto while on platform 80. In optional variations, platform 80 may be formed as a stretcher or a cargo or storage platform or container for personnel or equipment.

In a further optional accessory, surround shield assembly 10 may include a pair of protective wheel well panels 110, as visible in FIGS. 10 and 11. Wheel well panels 110 include protective panel assemblies arranged between the front wheels of the host vehicle and the interior of the surround shield assembly. As illustrated, wheel well panels 110 include a mostly vertically oriented lower panel 112 connected to an upper panel 114. Upper panel 114 may be angled or curved to extend forward and partially over a wheel contained in the wheel well.

While the disclosure has been illustrated and described in detail in the drawings and foregoing description, the same is to be considered as illustrative and not restrictive in character, it being understood that only the preferred example has been shown and described and that all changes, equivalents, and modifications that come within the spirit of the disclosures defined by following claims are desired to be protected.

The invention claimed is:

1. A protective surround shield assembly mountable onto a host vehicle to convert the host vehicle into a protective mobile structure, comprising:

a. a frame attachable and detachable from the host vehicle wherein attaching the frame adds an enclosure to protect occupants of the host vehicle, and wherein detaching the frame removes the enclosure;

b. wherein the host vehicle is an all-terrain vehicle (ATV) or a utility vehicle (UTV);

c. the frame including a front panel of a ballistic material facing a forward direction of the host vehicle wherein the front panel contains one or more sub-panels formed of a transparent material;

d. the frame including a pair of lateral side panels of a ballistic material, the lateral side panels extending rearward from the front panel and parallel to sides of the host vehicle, wherein each lateral side panel defines an opening allowing users access to a seat area and a control portion of the host vehicle; and e. a pair of door panels of a ballistic material, each hingedly mounted to a respective lateral side panel, wherein the door panels are operable between a closed configuration against the respective lateral side panel and covering the lateral side panel opening, and an open configuration allowing users access to the seat area and control portion of the host vehicle.

2. The protective surround shield assembly of claim 1, wherein the frame includes a rear panel facing a rearward direction of the host vehicle.

3. The protective surround shield assembly of claim 2, wherein portions of the rear panel are formed of a transparent material.

4. The protective surround shield assembly of claim 1, wherein in the open configuration, the door panels provide an extended forward facing protective face in cooperation with the front panel.

5. The protective surround shield assembly of claim 1, wherein the door panels contain extension panels which are deployable downward to provide protection to legs and feet of a user standing behind a door panel.

6. The protective surround shield assembly of claim 5, wherein the extension panels include an upper panel mounted to the door panel and a lower panel connected to the upper panel via a hinge, allowing the lower panel to be folded upward for storage or deployed downward.

7. The protective surround shield assembly of claim 5, wherein the extension panels are mounted to slide vertically between a deployed position and a stored position.

8. The protective surround shield assembly of claim 1, wherein the frame includes a roof panel assembly attached to an upper portion of the frame.

9. The protective surround shield assembly of claim 8, wherein portions of the roof panel assembly are formed of a transparent material.

10. The protective surround shield assembly of claim 1, comprising a rearward extending platform which can be secured to a trailer hitch on the host vehicle.

11. The protective surround shield assembly of claim 10, wherein the frame includes at least one of straps or handles on a rear side.

12. A protective surround shield assembly mountable onto a host vehicle to convert the host vehicle into a protective mobile structure, comprising:

a. a frame attachable and detachable from the host vehicle wherein attaching the frame adds an enclosure to protect occupants of the host vehicle, and wherein detaching the frame removes the enclosure;

b. wherein the host vehicle is an all-terrain vehicle (ATV) or a utility vehicle (UTV);

c. the frame including a front panel of a ballistic material facing a forward direction of the host vehicle wherein the front panel contains one or more sub-panels formed of a transparent material;

d. the frame including a pair of lateral side panels of a ballistic material extending from the front panel rearward and parallel to sides of the host vehicle, wherein each lateral side panel defines an opening allowing users access to a seat area and a control portion of the host vehicle;

e. the frame including a rear panel of a ballistic material facing a rearward direction of the host vehicle; and f. a pair of door panels of a ballistic material, each hingedly mounted to a respective lateral side panel.

13. The protective surround shield assembly of claim 12, wherein the front panel includes a central front panel and a pair of side front panels angled and sized to extend from lateral edges of the central front panel to forward edges of the lateral side panels.

14. The protective surround shield assembly of claim 12, wherein the front panel includes a nose panel extending downward to protect a front end of the host vehicle.

15. The protective surround shield assembly of claim 12, wherein the door panels are removable from the frame by users to be used as portable shields.

16. A protective surround shield assembly mountable onto a host vehicle to convert the host vehicle into a protective mobile structure, comprising:

a. a frame attachable and detachable to the host wherein attaching the frame adds an enclosure to protect occupants of the host vehicle, and wherein detaching the frame removes the enclosure;

b. wherein the host vehicle is an all-terrain vehicle (ATV) or a utility vehicle (UTV);

c. the frame including a front panel of a ballistic material facing a forward direction of the host vehicle wherein the front panel contains one or more sub-panels formed of a transparent material;

d. the frame including a rear panel of a ballistic material facing a rearward direction of the host vehicle;

e. the frame including a pair of lateral side panels of a ballistic material extending from the front panel to the rear panel, wherein each lateral side panel defines an opening allowing users access to a seat area and a control portion of the host vehicle; and f. a pair of door panels of a ballistic material each hingedly mounted to a respective lateral side panel, wherein the door panels are operable between a closed configuration covering the openings in the respective lateral side panels and an open configuration.

17. The protective surround shield assembly of claim 16, wherein the door panels each contain one or more sub-panels formed of a transparent material.

18. The protective surround shield assembly of claim 16, wherein the door panels include extension panels which are deployable downward to provide protection to legs and feet of a user standing behind a door panel.

* * * * *